US010000916B2

(12) United States Patent
Bruce

(10) Patent No.: US 10,000,916 B2
(45) Date of Patent: Jun. 19, 2018

(54) AUXILIARY WATER RECEPTACLE APPARATUS

(71) Applicant: Steve Bruce, Pasadena, CA (US)

(72) Inventor: Steve Bruce, Pasadena, CA (US)

( * ) Notice: Subject to any disclaimer, the term of this patent is extended or adjusted under 35 U.S.C. 154(b) by 0 days. days.

(21) Appl. No.: 14/756,568

(22) Filed: Sep. 18, 2015

(65) Prior Publication Data

US 2017/0362805 A1 Dec. 21, 2017

(51) Int. Cl.

| | |
|---|---|
| ***E03D 1/00*** | (2006.01) |
| ***E03D 1/22*** | (2006.01) |
| ***E03D 5/00*** | (2006.01) |

(52) U.S. Cl.

CPC ..... *E03D 1/003* (2013.01); *E03D 1/22* (2013.01); *E03D 5/006* (2013.01)

(58) Field of Classification Search

CPC .. E03D 1/00; E03D 1/003; E03D 1/02; E03D 1/22; E03D 5/00; E03D 5/003; E03D 5/006

USPC ..... 4/317, 340–342, 363, 665

See application file for complete search history.

(56) References Cited

U.S. PATENT DOCUMENTS

| | | | | | |
|---|---|---|---|---|---|
| 278,558 | A | * | 5/1883 | Keely | E03D 1/00 4/340 |
| 452,962 | A | * | 5/1891 | Beekman | E03D 1/22 122/389 |
| 1,868,700 | A | | 7/1932 | Gannon et al. | |
| 2,545,338 | A | * | 3/1951 | Bowden | E03D 1/003 4/227.1 |
| 2,860,348 | A | | 11/1958 | McClenahan | |
| 3,428,964 | A | * | 2/1969 | Lucas | A47K 1/04 4/665 |
| 4,163,293 | A | | 8/1979 | Basterfield | |
| 4,371,992 | A | * | 2/1983 | Rivera | E03D 5/003 4/353 |
| 4,377,875 | A | * | 3/1983 | Brubakken | A47K 4/00 4/321 |
| 4,646,780 | A | | 3/1987 | Spooner | |

FOREIGN PATENT DOCUMENTS

| | | | | |
|---|---|---|---|---|
| FR | 2995329 | * | 3/2014 | E03D 5/003 |

* cited by examiner

*Primary Examiner* — J. Casimer Jacyna
(74) *Attorney, Agent, or Firm* — Buche & Associates, P.C.; John K. Buche; Bryce A. Johnson

(57) ABSTRACT

For combination with a flush toilet water tank having a side wall, a pond water receptacle integrated with said tank side wall at the exterior of the tank, the receptacle opening upwardly, there being a water passage through the tank side wall, whereby pond water in the receptacle has a gravity determined top level at approximately the same level as water in the tank, and a removable cover extending over water in the receptacle, protecting against contaminated pond water gaining access to tank water.

2 Claims, 4 Drawing Sheets

10
11
12
12a
13
15
18
20
23

10
11
12
13
15
19
21
23

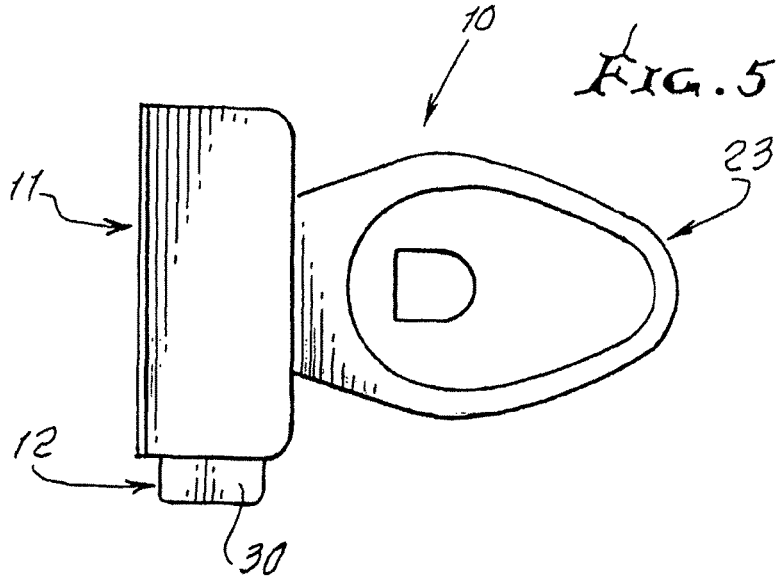
FIG. 5
FIG. 6
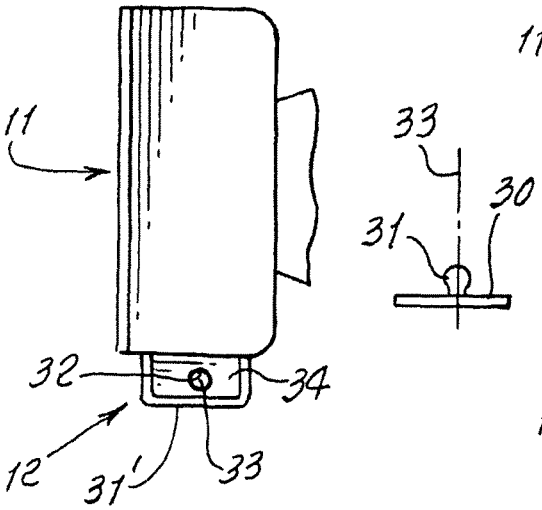
FIG. 6a
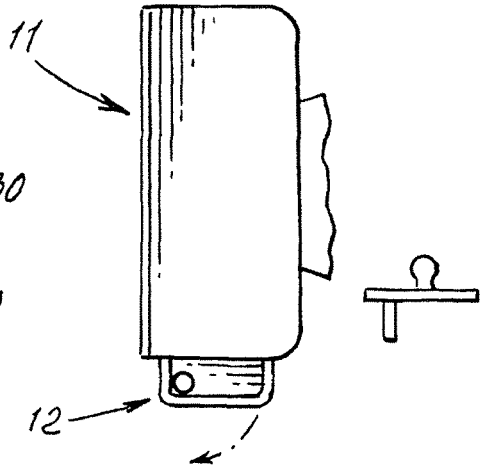

AUXILIARY WATER RECEPTACLE APPARATUS

BACKGROUND OF THE INVENTION

This invention relates generally to fresh water sources in association with toilet apparatus; and more particularly concerns receptacles for fresh water easily accessible proximate toilet water tanks.

Accessibility of fresh water near heavy lid covered toilet water tanks is a needed objective, though possibly infrequent. Use of main large water containing tanks for fresh water is possibly but not desirable due to weight and large size of components. There is need for an easily usable source of fresh water in conjunction with functioning of toilet water supply tanks.

SUMMARY OF THE INVENTION

It is a major object of the invention to provide an easily usable relatively shallow pond-like source of fresh water, accessible at or near the side of a relatively large tank containing toilet flush water, and in protected position. Such need extends to provision of:

a) a protected pond water receptacle integrated with the tank side wall at the exterior of the tank, the receptacle opening upwardly, b) a sub-surface water passage through the tank side wall, whereby pond water in the receptacle has a gravity determined top level at approximately the same level as water in the tank, Another object comprises provision of a removable cover extending over water in the receptacle, protecting against possibly contaminated pond water gaining access to tank water. In this regard water in the smaller receptacle typically extends upwardly to a top surface level less than about one inch below an upper rim defined by the receptacle.

Another object includes provision of a sub-surface water passage as referred to, which communicates with the lower interior of the receptacle, to assure water replacement in the receptacle each time the toilet is flushed to drain water from the larger tank.

A further object comprises provision of a shiftable or rotatable cover or lid for the receptacle, allowing its rotation to variably cover pond water in the receptacle and allowing downward dipping of a cloth into the receptacle to be wetted, for cleaning purposes.

Yet another object includes provision of valving integrated with the receptacle operable in conjunction with provision for maintenance of different water surface levels in the main water tank to enable cleaning of the interior of the pond receptacle as during and after flushing of water from the main water tank. In this regard, such valving may include i) primary valving associated with ducting between the main tank and the pond receptacle, ii) secondary valving associated with drain ducting from the pond receptacle.

An added object includes provision for opening of the secondary valving during closed condition of the primary valving to lower the surface level of pond water relative to the surface level of water in the main tank, to enable cleaning of the pond receptacle isolated from water in the main tank. Such primary valving is subsequently open to enable gravity forced inflow of clean water from the main tank into the contaminated cleaning water in the pond tank, followed by outflow of the mixed clean and contaminated water from the pond water tank into the lower extent of the main tank, as during flushing.

Added objects include:

- no plumbing hardware needed, for normal operation;
- 100% gravity flow, under different operation conditions;
- pond water replacement with every flush, keeping water fresh and clean without mess of faucet tap or introduction of foreign materials;
- pond receptacle may be is cast into mold for toilet tank, and may be made from same materials as the toilet/tank;
- no need for water to be replenished by tap above pond water level. Extra hardware, to avoid splashes during gravity feed to bring water level in pond to water level of tank, can be avoided with openings on tank wall to pond;
- the "Personal Pond" is typically integrated into structure of toilet tank, and is seamless. The pond component may be cast into toilet/tank mold;
- pond receptacle is made from same materials as toilet/tank (clay being poured into mold, finished, glazed and heated in kiln);
- pond receptacle may be seamless to tank, as single construction/manufacture, avoiding leaks and seams.
- simplicity of manufacturing and simplicity of use by consumer are desired advantages;
- the pond lid fits over the top opening of the pond and can be removed for easy access to pond, as for cleaning. A smaller lid that matches the design of the larger toilet tank lid, is enabled;
- an alternate lid features a "dowel like" component in the outside, rear, or underside corner of lid that corresponds with an opening in pond receptacle for insertion of dowel extending from lid. This allows lid to be rotated to allow easy access to pond water.

These and other objects and advantages of the invention, as well as the details of an illustrative embodiment, will be more fully understood from the following specification and drawings, in which:

DRAWING DESCRIPTION

FIG. 5 is a top plan view;

FIG. 6 is a top view and a modification; and FIG. 6*a* is like FIG. 6, but showing structure modified positioning;

Figure 1:
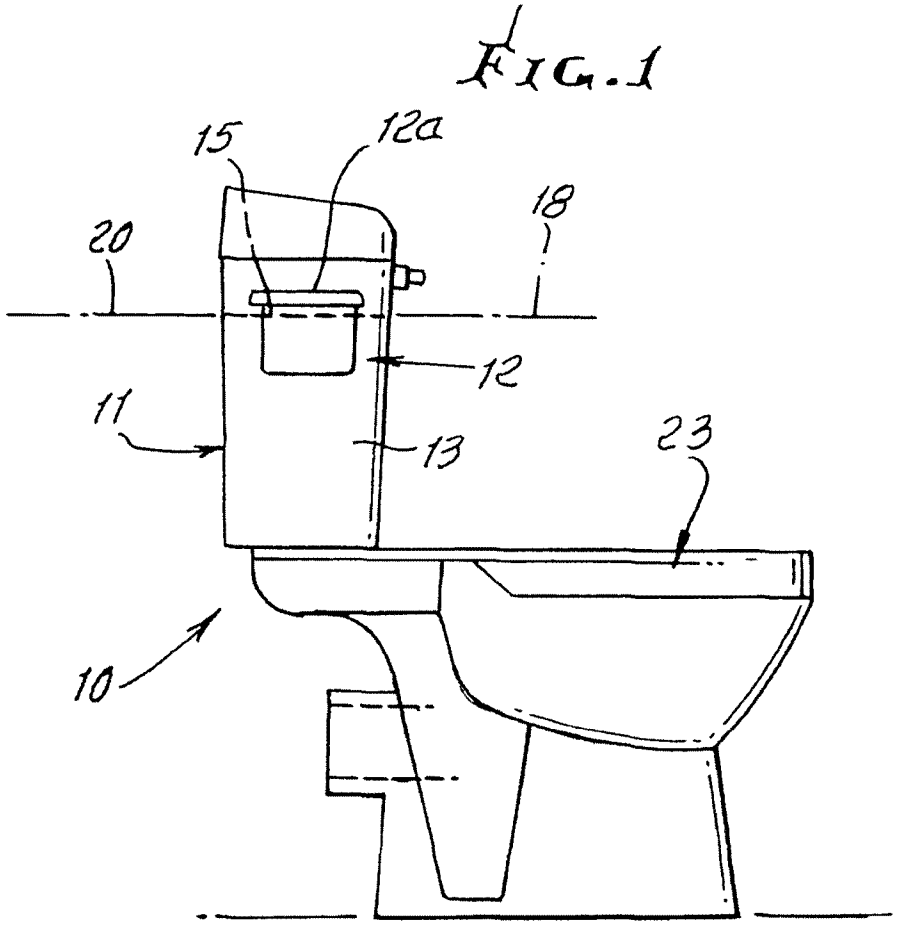
FIGS. 1 and 2 are side and end elevations of a toilet, toilet tank, and smaller pond receptacle.
Figure 2:
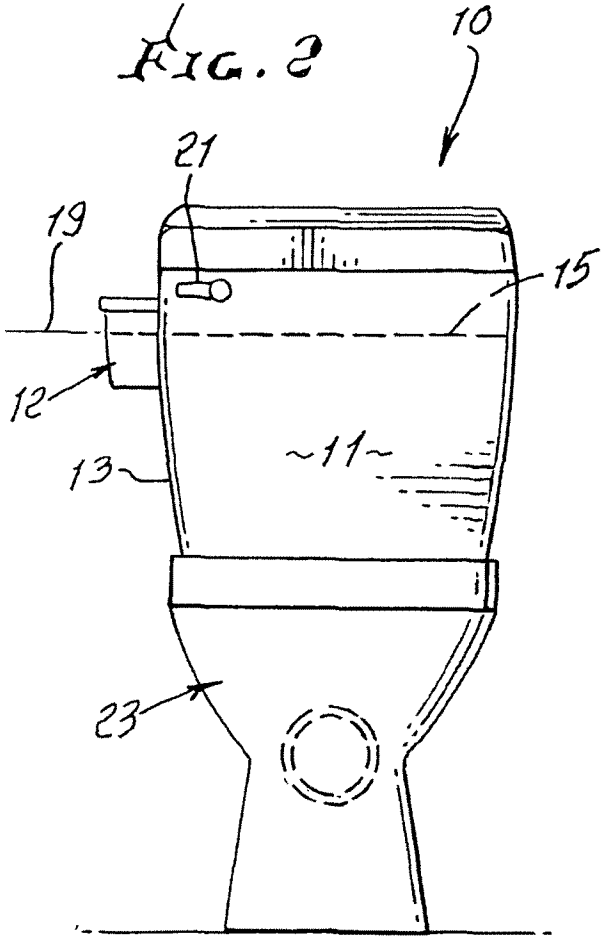

FIGS. 7*a*-7*e* are fragmentary views of modes of operation.

DETAILED DESCRIPTION

In FIGS. 1-4, a toilet or water tank installation 10 is shown. An auxiliary pond water receptacle, or cistern 12 is also shown, installed on a side wall 13 of tank 11. A through opening 14 between the interiors of 11 and 12 is provided, whereby flushing water 15 in tank 11 gains access to and supplies water 16 to the interior of the cistern. Water levels 18 and 19 in 11 and 12 are therefore the same, as indicated by surface level line 20. The top edge level of 12 appears at 12*a*, higher than water level line 20. When a hand-operated flush lever 21 is rotated, water leaves tank 11 and cistern 12 to flush the toilet 23.

Figure 3:
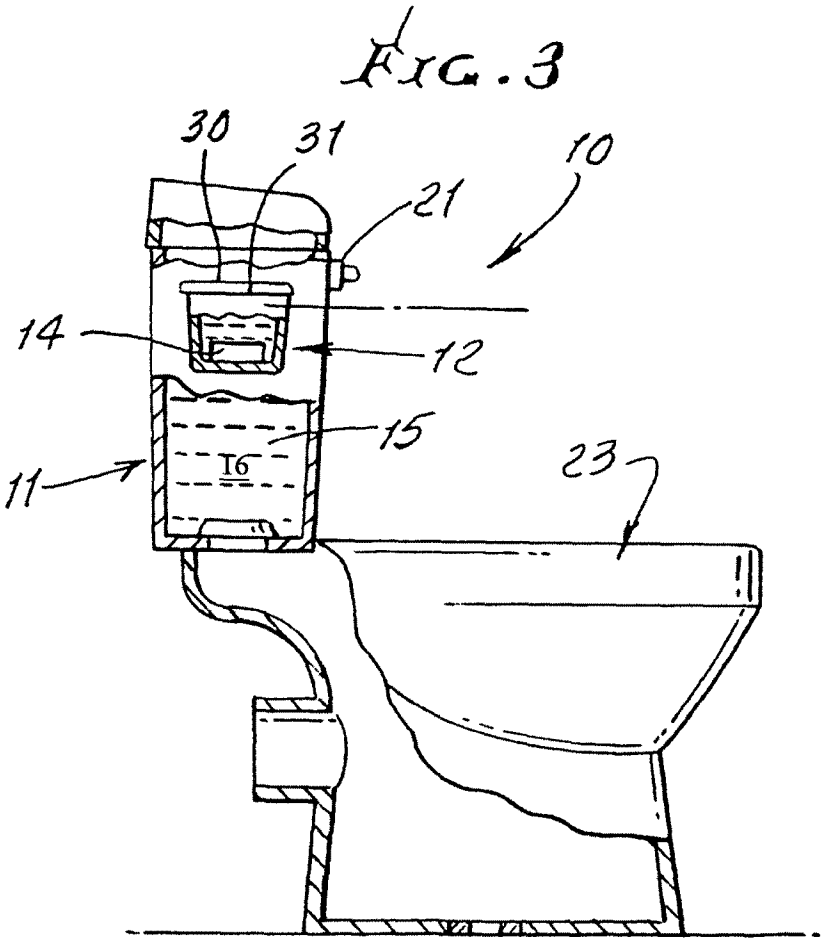
FIGS. 3 and 4 are like FIGS. 1 and 2, but are sectioned to show internal constructions.
Figure 4:
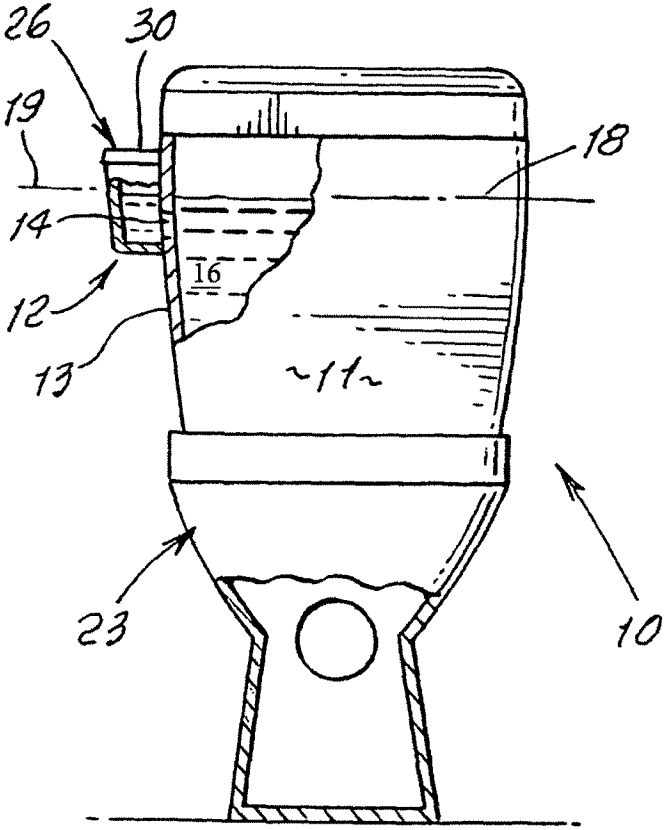

As seen at 26 in FIG. 3, a removable lid 30 is seated on upper rim 31 of the cistern 12. It may be rotated between closed and open positions, about a vertical axis 33 by provision of a lid carried dowel 31 received in opening 32 on the cistern wall. See FIG. 6. Dowel axis 33 is also seen.

Figure 7A:
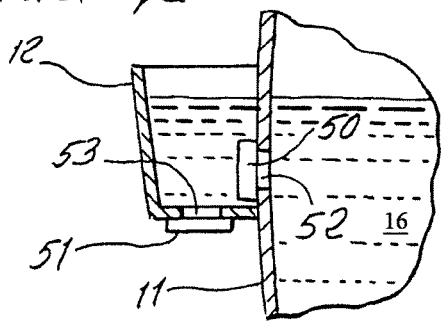
Figure 7B:
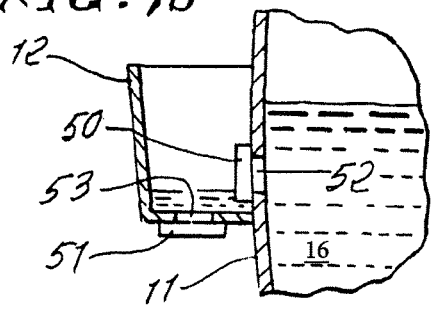
Figure 7C:
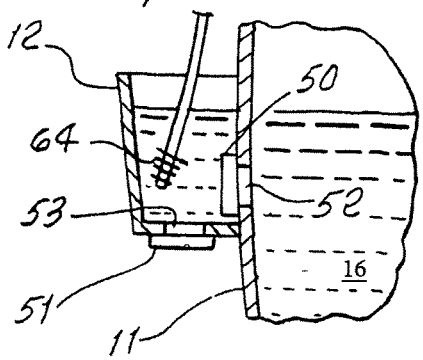

A secondary valve 51 in the bottom wall 34 of the cistern is provided to discharge water such as contaminated water from the cistern, as when a primary valve 50 is closed, to close downward opening 53, after cleaning of cistern as by brush 36 seen in FIG. 7*c*. Thereafter, valve 51 is closed, and the cistern re-fills after opening of valve 50 that controls communication between the water in tank 11 and water in the receptacle 12. See schematic FIG. 7*a*-7*e* views.

In the FIG. 7*a*-7*e* views, a step-by-step cleaning of the pond receptacle is shown.

In FIG. 7*a*, primary valve 50 is open and secondary valve 51 is closed. Valve 50 controls an opening 52 between tank 11 and cistern 12; and valve 51 controls a discharge opening 53 from cistern to the exterior.

In FIG. 7*b*, valve 50 is closed and valve 51 is open. This allows discharge of cistern water without discharging contents of 11. Water level in the cistern may be dropped prior to cleaning.

In FIG. 7*c*, both valves 50 and 51 are closed, and a brush 64 is inserted into 12 and the brush is moved about, for cleaning of walls of the cistern.

Figure 7D:
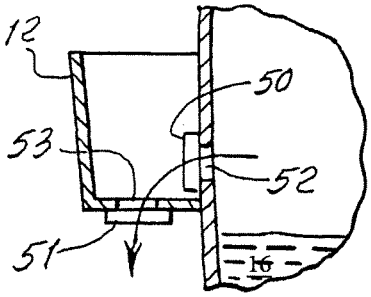

In FIG. 7*d*, both valves are open to effect discharge of contaminated water, and flushing of the cistern by water from the tank 11.

Figure 7E:
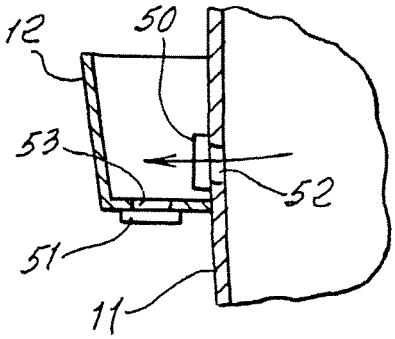

In FIG. 7*e*, valve 50 is open and valve 51 closed, to allow re-fill of the cistern with clean water from the tank. This reestablishes the common surface level of water in tank 11 and the cistern.

I claim:

1. A flush toilet water tank combined with a pond water receptacle, wherein:

(a) the pond water receptacle (i) includes an upwardly oriented opening and (ii) is integrated with a side wall of said flush toilet water tank so that the pond water receptacle is located on the exterior of the flush toilet water tank;

(b) a passage is provided through said side wall of said flush toilet water tank and the passage includes a primary valve that may be opened to provide fluid communication via said passage between said flush toilet water tank and said pond water receptacle and that may be closed to shut-off said fluid communication between the flush toilet water tank and the pond water receptacle whereby pond water in the pond water receptacle has a gravity determined top level that settles with the surface level of water in the flush toilet water tank whenever the primary valve is opened and whereby pond water in the pond water receptacle has a gravity determined top level that does not settle with the surface level of the water in the flush toilet tank whenever the primary valve is closed;

(c) a removable cover extends over the upwardly oriented opening of the pond water receptacle to protect the pond water in the pond water receptacle against contamination entering the pond water receptacle through the upwardly oriented opening;

(d) a drain with a secondary valve is provided in a bottom wall of the pond water receptacle so that the secondary valve of the drain may be opened when said primary valve is closed to discharge water in the pond water receptacle through said drain so that the top level of the pond water is lowered without the surface level of water in the flush toilet settling with the top level of pond water, (e) the pond water in the pond water receptacle is isolated from water in the main tank whenever the primary valve is closed so that the pond water receptacle may be cleaned without fluid communication between the pond water receptacle and the flush toilet water tank.

2. The flush toilet water tank combined with a pond water receptacle of claim 1 wherein after the primary valve is closed, the secondary valve opened, and the pond water drained from the pond water receptacle so that said gravity determined top level is lowered, said secondary valve may be closed and said primary valve be opened to cause the surface level of water in the flush toilet to settle with the top level of the pond water.

* * * * *